US010640983B2

(12) United States Patent
Honeycutt et al.

(10) Patent No.: US 10,640,983 B2
(45) Date of Patent: May 5, 2020

(54) PLATFORM SYSTEM

(71) Applicant: Safe Rack LLC, Andrews, SC (US)

(72) Inventors: Robert W. Honeycutt, Pawleys Island, SC (US); Joseph N. Lane, Murrells Inlet, SC (US); Carson Allan Jones, Andrews, SC (US); Paul Thomas King, Jr., Florence, SC (US)

(73) Assignee: Safe Rack LLC, Andrews, SC (US)

( * ) Notice: Subject to any disclaimer, the term of this patent is extended or adjusted under 35 U.S.C. 154(b) by 0 days.

(21) Appl. No.: 15/466,465

(22) Filed: Mar. 22, 2017

(65) Prior Publication Data

US 2017/0275888 A1 Sep. 28, 2017

Related U.S. Application Data

(60) Provisional application No. 62/312,260, filed on Mar. 23, 2016.

(51) Int. Cl.

| | |
|---|---|
| ***E04F 11/035*** | (2006.01) |
| ***E04F 11/112*** | (2006.01) |
| ***E04F 11/025*** | (2006.01) |
| ***E04G 27/00*** | (2006.01) |
| *E04F 11/02* | (2006.01) |
| *E04F 11/18* | (2006.01) |

(52) U.S. Cl.

CPC ..... *E04F 11/035* (2013.01); *E04F 11/025* (2013.01); *E04F 11/112* (2013.01); *E04G 27/00* (2013.01); *E04F 2011/0209* (2013.01); *E04F 2011/187* (2013.01); *E04F 2011/1868* (2013.01)

(58) Field of Classification Search

CPC ..... E04F 11/035; E04F 11/025; E04F 11/022; E04F 2011/1868; E04F 2011/187; E04G 5/142; E04G 27/00

USPC ..... 182/119, 123, 130

See application file for complete search history.

(56) References Cited

U.S. PATENT DOCUMENTS

| | | | |
|---|---|---|---|
| 1,460,680 | A | 7/1923 | Peters |
| 1,576,635 | A | 3/1926 | Douglas |
| 1,593,783 | A | 7/1926 | Stresau |
| 1,960,863 | A | 5/1934 | Boyer |

(Continued)

FOREIGN PATENT DOCUMENTS

| | | | |
|---|---|---|---|
| CA | 2421184 | A1 | 3/2002 |
| CA | 2491124 | A1 | 1/2004 |

(Continued)

OTHER PUBLICATIONS

"Multi-Access Component System Assembly Guide," Cabis Incorporated, 2002, modified in 2005, all enclosed pages cited.

*Primary Examiner* — Marcus Menezes

(74) *Attorney, Agent, or Firm* — Nelson Mullins Riley & Scarborough, LLP

(57) ABSTRACT

A platform system comprising a platform structure having at least one modular platform unit with platform connection features on a side surface thereof to which other components can be connected, the other components including at least two of the following: another modular platform unit, a stair unit, a tower unit, a handrail unit, and a ladder unit. A stair assembly is connected to the platform structure via said connection features, the stair assembly comprising a plurality of stair units connected together to provide a number of steps equal to the sum of steps of the stair units.

9 Claims, 14 Drawing Sheets

(56) References Cited

U.S. PATENT DOCUMENTS 2,335,046 A 11/1943 Droeger
2,585,150 A 2/1952 McGill
2,594,561 A 4/1952 Huck
2,694,609 A 11/1954 Trafford
2,726,123 A 12/1955 Matthews
2,899,011 A 8/1959 Babits
2,989,141 A 6/1961 Howard
3,042,140 A 7/1962 Basile et al.
3,104,889 A 9/1963 Branch, Jr.
3,250,401 A 5/1966 Davidson
3,307,653 A 3/1967 Gnehm
3,349,870 A 10/1967 Leiblein
3,381,775 A 5/1968 Livers
3,477,184 A 11/1969 Johnson et al.
3,500,606 A 3/1970 Wharmby
3,693,754 A 9/1972 Butler
3,698,511 A * 10/1972 Dohan ..... E04G 1/14 182/113
4,009,762 A 3/1977 Bjerkgard
4,030,255 A * 6/1977 Hartman ..... E04H 3/123 182/106
4,060,150 A 11/1977 Hughes
4,143,740 A * 3/1979 Matthews ..... E04F 11/025 182/93
4,175,889 A 11/1979 Phaup et al.
4,352,597 A 10/1982 Kay
4,355,700 A * 10/1982 Matthews ..... E06C 9/02 182/106
4,419,851 A * 12/1983 Kruger ..... E04F 11/18 52/184
4,424,752 A 1/1984 Aberg
4,527,366 A * 7/1985 Greene ..... E04F 11/025 182/83
4,630,709 A 12/1986 Taylor
4,759,162 A 7/1988 Wyse
4,869,034 A * 9/1989 Hammond ..... E04F 11/035 52/184
4,919,230 A 4/1990 Langer et al.
5,002,153 A 3/1991 Yuen
5,031,723 A 7/1991 Hooten
5,337,857 A 8/1994 Spelt et al.
5,408,790 A 4/1995 Hoesten et al.
5,547,041 A 8/1996 Gispert
5,617,931 A 4/1997 Zygmun et al.
5,653,459 A 8/1997 Murphy
5,779,208 A 7/1998 McGraw
5,911,288 A 6/1999 Zafirakis
6,032,590 A 3/2000 Chen
6,085,867 A * 7/2000 Daniel ..... E04F 11/112 182/113
6,763,912 B2 7/2004 Robinson et al.
6,810,995 B2 11/2004 Warford
6,918,464 B2 7/2005 Renton et al.
7,500,335 B1 3/2009 Kjose
D608,459 S 1/2010 Wyse
D619,445 S 7/2010 Wyse
7,950,095 B2 5/2011 Honeycutt
8,046,858 B2 11/2011 Honeycutt
8,261,393 B2 9/2012 Honeycutt et al.
8,341,821 B2 1/2013 Honeycutt
8,387,191 B2 3/2013 Honeycutt
8,434,273 B1 5/2013 Greene
8,490,234 B2 7/2013 Rowell et al.
8,561,239 B2 10/2013 Honeycutt et al.
8,627,926 B2 1/2014 Gordon
8,746,403 B1 6/2014 Tyner et al.
8,813,430 B2 8/2014 Rees et al.
8,904,714 B2 12/2014 Montalto et al.
9,321,489 B1 4/2016 Dauner
10,358,871 B2 7/2019 Honeycutt
2001/0017233 A1 8/2001 Panzeri
2002/0189177 A1 12/2002 Eve et al.
2004/0231920 A1 11/2004 Meeker
2005/0193675 A1 9/2005 Smart et al.
2007/0125602 A1 6/2007 Marbach
2008/0202391 A1 8/2008 Pisano
2009/0180853 A1 7/2009 Gang
2010/0031455 A1 2/2010 Honeycutt et al.
2010/0326771 A1 12/2010 Kreller
2011/0047724 A1 3/2011 Honeycutt
2011/0198153 A1 8/2011 Dufour et al.
2011/0278094 A1* 11/2011 Gute ..... E04G 1/14 182/223
2012/0073902 A1* 3/2012 Honeycutt ..... E04F 11/025 182/113
2013/0015016 A1 1/2013 Honeycutt
2014/0367628 A1* 12/2014 Hewson ..... E04G 21/3242 256/65.14
2019/0338592 A1 11/2019 Honeycutt

FOREIGN PATENT DOCUMENTS

CA 2455312 A1 7/2005
DE 19503543 A1 * 8/1996 ..... E04F 11/181
EP 140984 A1 5/1985
FR 2672917 A1 8/1992
GB 945822 A 1/1964
GB 1212983 A 11/1970
GB 2185775 A 7/1987
GB 2318607 A 4/1998
JP 04277261 A * 10/1992
JP H06100021 B2 * 12/1994 ..... E04G 5/142
WO 0148321 A1 7/2001
WO 2005116369 A1 12/2005
WO 2009147004 A1 12/2009

* cited by examiner

PLATFORM SYSTEM

PRIORITY CLAIM

This application is based upon and claims the benefit of U.S. provisional application Ser. No. 62/312,260, filed Mar. 23, 2016, which is incorporated fully herein by reference in its entirety for all purposes.

FIELD OF THE INVENTION

The present invention relates to modular platform systems, such as are used to provide crossover platforms and access platforms in workplace environments.

BACKGROUND OF THE INVENTION

Platform systems are utilized in a variety of industrial and commercial facilities to provide access from one location to another. Generally speaking, such platform systems often fall into one of two categories: crossover platforms and access platforms. Crossover platforms function as bridges, providing a path over some obstruction, such as pipes or industrial machinery. Access platforms, on the other hand, typically allow a user to reach or access a desired area or object from another location.

Usually, platform systems are specially designed and constructed for a particular location and application. While this provides an acceptable platform for one situation, it is not adaptable or reconfigurable as the situation changes (or for another situation). To address this limitation, the art has provided modular platform systems which are configurable for use in a variety of different situations. These systems utilize a number of components, which can be selected and assembled according to the needs of a particular situation. In this way, a wide variety of different crossover and access platforms can be provided using different combinations and configurations of the available components. One such modular platform system is shown and described in U.S. Pub. No. 2013/0015016 ("the '016 publication"), filed on Jul. 16, 2011 and accorded application Ser. No. 13/184,499, which is incorporated herein by reference in its entirety for all purposes.

The present invention recognizes the foregoing considerations, and others, of the prior art.

SUMMARY OF THE INVENTION

In accordance with one aspect, the present invention provides a platform system comprising a platform structure having at least one modular platform unit with platform connection features on side surfaces thereof to which other components can be connected, the other components including at least two of another modular platform unit, a stair unit having a plurality of steps, a tower unit, a handrail unit, and a ladder unit. The platform system according to this aspect further includes a stair assembly connected to the platform structure via the platform connection features. The stair assembly comprises a plurality of stair units connected together to provide a number of steps equal to the sum of steps of the stair units. For example, the plurality of stair units may comprises at least three stair units each having no more than six steps.

According to some exemplary embodiments, the left and right stringers of each stair unit may comprise a side plate having upper and lower stair connection features for attachment of upper termination elements and base elements, respectively. Stair units of the stair assembly may be interconnected together at an interconnection location via web plates that are attached to the side plates using the stair connection features in lieu of upper termination elements and base elements at the interconnection location.

Handrail sections of the stair units may preferably be connected to form a continuous handrail along a length of the stair assembly. For example, the handrail sections of the stair units may be connected together using transition handrail sections. Internal couplings (e.g., comprising expansible coupling elements engaging an inner surface of the handrails for connecting the handrails together) may be used to connect the handrail sections together.

The platform system may further comprise a tower assembly connected to the platform structure via the platform connection features, the tower assembly comprising a plurality of tower units connected together to provide a total height corresponding to a height of the stair assembly. In such embodiments, the tower units may be interconnected using generally U-shaped brackets. Moreover, the handrail units and handrails of the stair assembly may be attached using a nut plate locking assembly inserted into a tubular end of a handrail support post.

According to another aspect, the present invention provides a stair assembly for use in a platform system. The stair assembly comprises a plurality of stair units each comprising a pair of left and right side plates having a plurality of spaced apart steps extending therebetween. The plurality of stair units are arranged such that left side plates of the plurality of stair units are axially aligned with each other and right side plates of the plurality of stair units are axially aligned with each other. Left side plates of adjacent stair units of the plurality of stair units are rigidly interconnected and right side plates of adjacent stair units of the plurality of stair units are rigidly interconnected.

For example, the adjacent left side plates and the adjacent right side plates may be in end-to-end abutment and interconnected via web plates. According to some preferred embodiments, the left side plates, the right side plates, and the web plates may be L-shaped. Furthermore, the left and right side plates of a lowermost stair unit may have respective removable base elements attached thereto. Likewise, the left and right side plates of an uppermost stair unit may have respective removable upper termination elements attached thereto.

A further aspect of the present invention provides a tower assembly for use in a platform system. The tower assembly comprises a plurality of tower units (e.g., two, three, or more) stacked one on top of the other, each of the tower units having an inverted generally U-shaped configuration with a top portion and pair of depending leg portions. Adjacent tower units are interconnected via a pair of removable side brackets.

According to some embodiments, each of the tower units comprises at least one cross-support extending between the depending leg portions. First and second removable base fittings may be attached to respective of the depending leg portions of a lowermost tower unit of the plurality of tower units. A separate top piece may be located above the top portion of an uppermost tower unit of the plurality of tower units. The top portion and the depending leg portions of the tower units may be formed of rectangular tubing.

A still further aspect of the present invention provides a method of assembling a stair assembly for use in a platform system. One step of the method involves obtaining a plurality of stair units each comprising a pair of left and right side plates having a plurality of spaced apart steps extending therebetween. The plurality of stair units are arranged such that left side plates of the plurality of stair units are axially aligned with each other and right side plates of the plurality of stair units are axially aligned with each other. Another step involves rigidly interconnecting the left side plates of adjacent stair units of the plurality of stair units and right side plates of adjacent stair units of the plurality of stair units using a plurality of web plates.

According to another aspect, the present invention provides a combination comprising a plate structure defining at least one fastener through-hole. A tubular member defining a fastener receipt hole is also included. A nut plate locking device having a nut plate and an associated spring plate is received in the tubular member, the spring plate carrying at least one spring urging it away from the nut plate. The nut plate has a threaded hole aligned with the fastener through-hole of the plate structure and the fastener receipt hole of the tubular member. A threaded fastener extends through the fastener through-hole of the plate structure and the fastener receipt hole of the tubular member into threaded engagement with the threaded hole of the nut plate such that the tubular member is connected to the plate structure.

A washer piece having a flat side and a curved side may be situated between the plate structure and the tubular member. Moreover, the nut plate locking device may have a flange located at one end thereof to limit insertion into the tubular member. According to some embodiments, the threaded hole may be defined by a nut attached to the nut plate.

Other objects, features and aspects of the present invention are provided by various combinations and subcombinations of the disclosed elements, as well as methods of practicing same, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
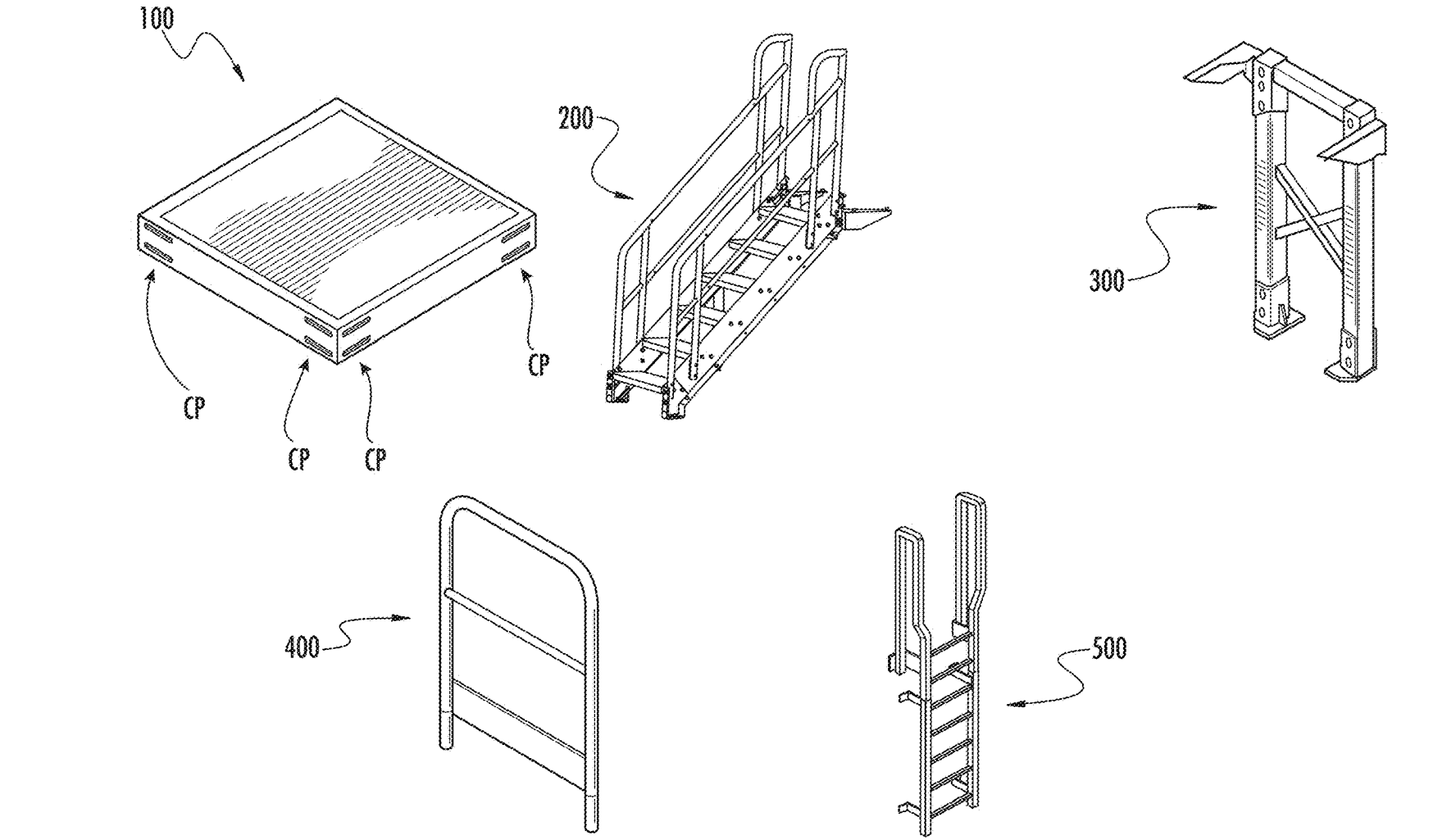
FIG. 1 shows types of components that may be used in a platform system in accordance with an embodiment of the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

FIG. 1 illustrates primary components of an exemplary platform system in accordance with an embodiment of the present invention. Such components include modular platform units 100, stair units 200, tower (or "stand") units 300, platform handrails 400, and ladders 500. The components may be assembled in different ways, and in different combinations, to provide a platform needed in a particular situation. In this case, the illustrated components are compatible and interchangeable with components of the platform system described in the '016 publication. For example, the modular platform units may have a square configuration as shown, with platform connection features CP on side surfaces thereof to which other components (such as another modular platform unit) can be connected. In this embodiment, the connection features are formed as a series of slots at each side surface.

Figure 2:
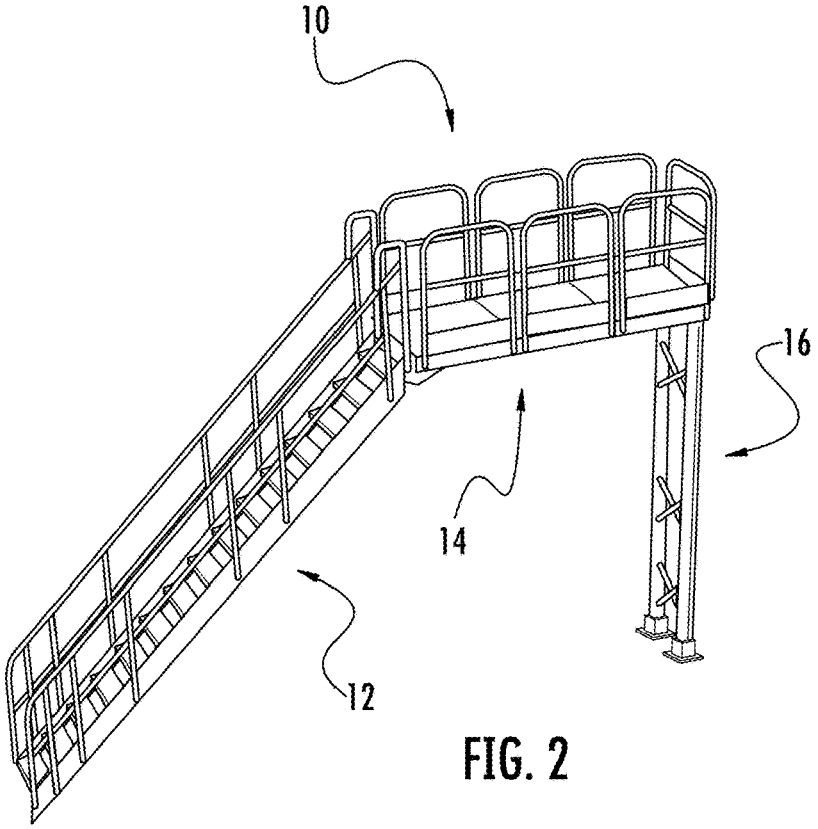
FIGS. 2 and 3 are perspective views illustrating an access platform (FIG. 2) and a modification thereof (FIG. 3) that can be configured using different combinations of the components.

FIG. 2 illustrates a platform assembly 10 formed of combinations of components as shown in FIG. 1. In this regard, assembly 10 includes a stairway 12 leading to one end of an elevated platform 14. The other end of platform 14 is supported at the desired elevation by a support tower 16. Handrails are located along the sides of stairway 10, as well as sides of platform 14. If necessary for access purposes, or unnecessary for safety (such as if the platform assembly is beside a wall), some of these handrails might not need to be provided.

In this example, each of stairway 12, platform 14, and tower 16 is formed of a plurality of smaller units that are preferably assembled on-site. For example, stairway 12 has fifteen stairs ("steps") along its rise, and may be formed of three 5-step units (or a 6-step unit, a 5-step unit, and a 4-step unit, etc.). Similarly, the tower 16 may be formed of multiple tower units assembled on site to achieve the desired height. Different heights of tower units may be sold so that the tower heights correspond to the different heights of stairways (or ladders) that can be formed using components of the system. As can be seen, platform 14 is formed in this example of three platform units 100 connected to form a longer rectangular platform. One skilled in the art will recognize, however, that more or fewer platform units 100 can be provided, and they can be connected to form various shapes of platforms, such as rectangular platforms, L-shaped platforms, T-shaped platforms, etc. In a preferred embodiment, platform units 100 may be identical to the modular platforms in the '016 publication, having standard connection features (e.g., a pattern of holes for fasteners) on all four sides thereof.

Figure 3:
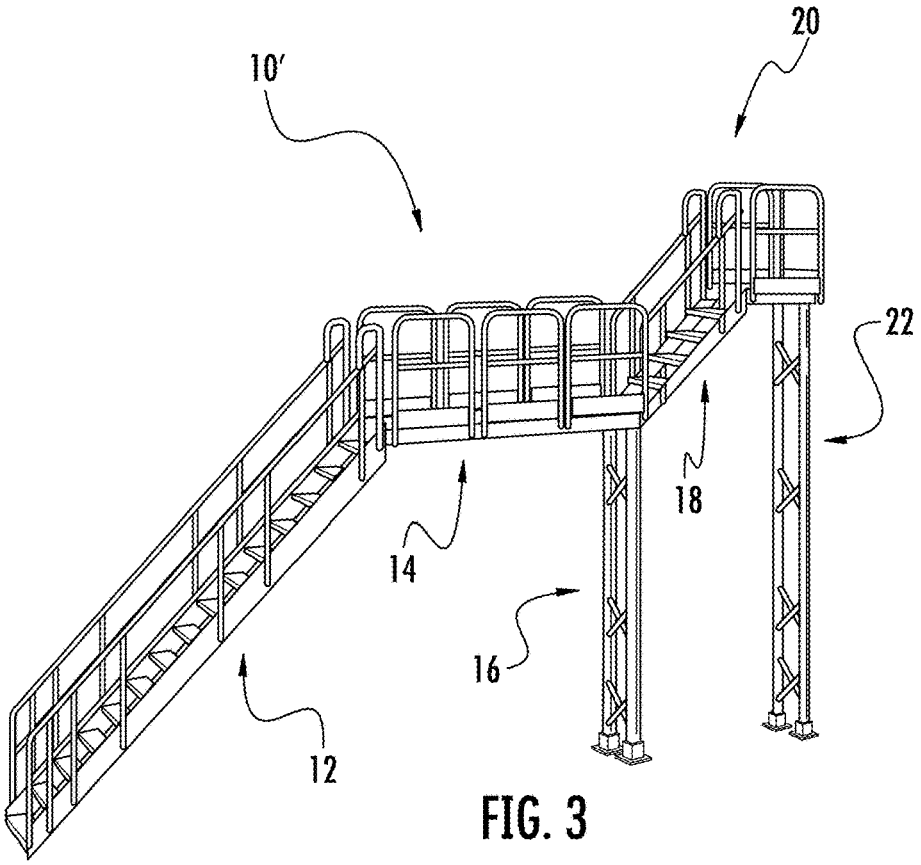

FIG. 3 shows a modification of platform assembly 10, denoted 10', in which a second stairway 18 has been attached to the distal end of platform 14. In this case, stairway 18 is a single 5-step unit, although different size units or combinations thereof may be used at this location also. In this variation, platform 14 serves as a landing en route to a higher platform 20, which is supported on its other end by a tower 22. FIG. 3 thus illustrates one manner in which the overall platform system allows modifications and adaptations depending on the particular situation in which it will be used.

Because the stairs, towers, and ladders can be made to a desired height by combining a relatively small number of different units, a wide variety of platform heights can be achieved. In fact, a greater number of different platform heights can be achieved using a smaller number of dedicated component sizes than would otherwise be the case. For example, assuming the largest stair size available in a prior art platform system is an 11-step unit, it would not be possible to have a rise higher than eleven steps without an intervening landing. According to the present invention, a stair assembly of, for example, fifteen steps may be made by combining multiple units, such as three 5-step units. Thus, for example, the longest individual stair unit may be a 6-step unit, but longer stairways (i.e., greater heights) can still be achieved in comparison with the prior art by various combinations of the stair units (the same is true for the tower units and ladder units.) As a result, the manufacturer (or distributor) may stock a fewer number of different unit sizes while offering more platform system heights and combinations. This allows a reduction in inventory for the manufacturer and greater flexibility to the user. In addition, it is often cheaper to ship several smaller units than one larger unit, resulting in a reduction in shipping costs as well.

Figure 4:
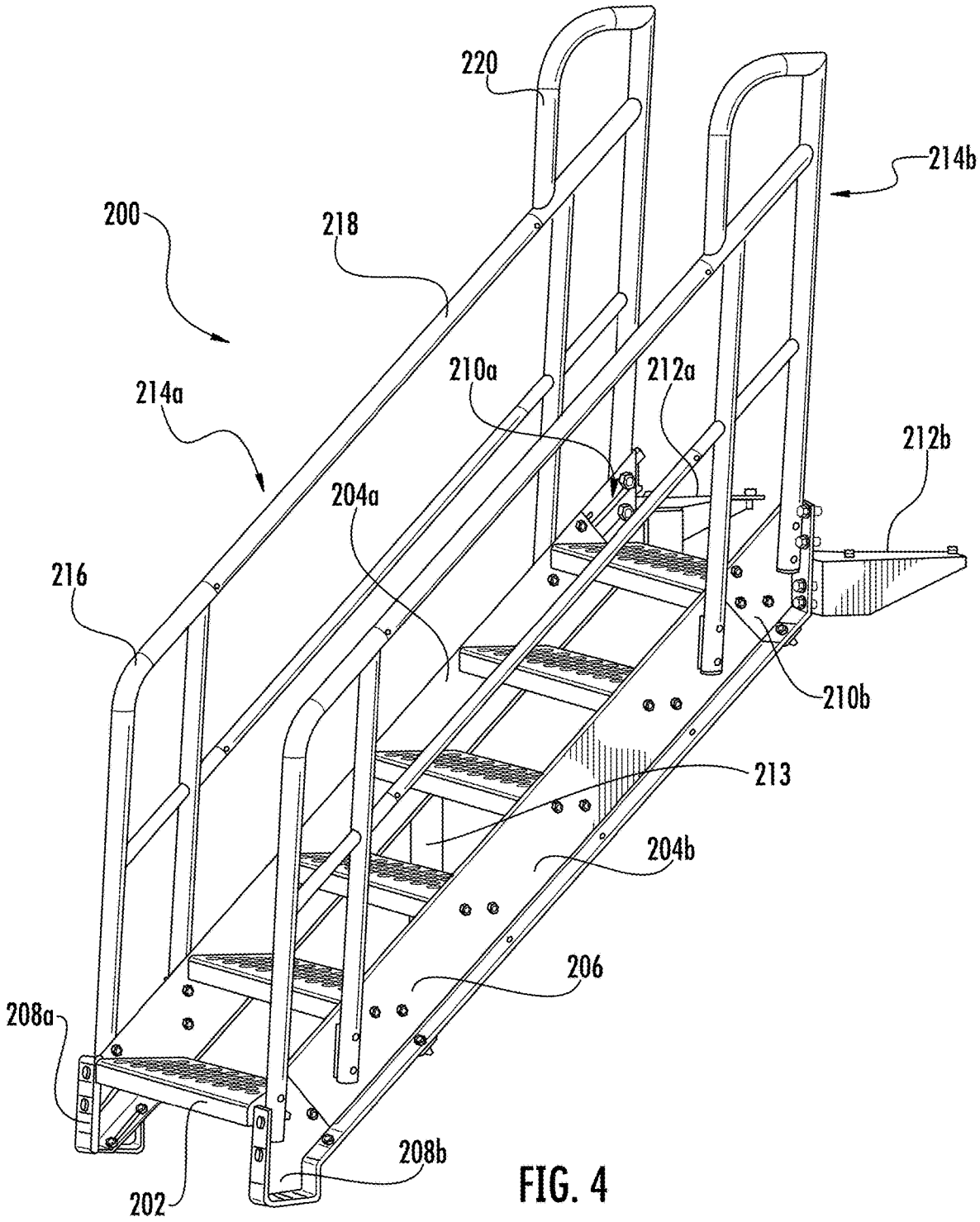
FIG. 4 is a perspective view of a stair unit (in this case a 6-step unit) in accordance with an embodiment of the present invention.

Referring now to FIG. 4, stair unit 200 can be described in more detail. As can be seen, stair unit 200 in this example has a total of six steps (such as step 202) that are attached to and extend between a pair of lateral stringers 204*a* and 204*b*. Each of the stringers comprises an L-shaped side plate, such as plate 206. For example, plate 206 may be a cut section of extruded steel stock. Connection features (e.g., various holes) may be located along plate 206 at regular and/or predetermined locations for attachment of the steps, handrails, and other features. In this regard, terminal elements may be removably attached to the ends of plate 206 for situations where stair unit 200 is at the bottom or top of the stairs (or is itself used as an entire set of stairs).

For example, the bottom of stair unit 200 in this case has a pair of base elements 208*a* and 208*b* attached to the respective side plate. As shown, base elements 208*a* and 208*b* define a flat bottom for resting against a support surface such as a floor. The top of stair unit 200 in this case has a pair of upper termination elements 210*a* and 210*b* also attached to the respective side plates. Base elements 208*a-b* and upper termination elements 210*a-b* may be formed in any suitable manner, such as casting. A pair of gussets 212*a* and 212*b* may be attached to the respective upper termination elements 210*a-b* for connection to the underside of a modular platform 100 (similar to the gussets described in the '016 publication). Cross supports (such as cross support 213) may extend between the stringers under the steps to provide additional structural integrity.

Stair unit 200 further has a pair of sloped handrails 214*a* and 214*b* also attached to the stringers 204*a* and 204*b*. Each of the handrails is preferably formed of three separable sections, namely lower section 216, middle section 218, and upper section 220. For example, lower section 216 can be removed (along with base elements 208*a* and 208*b*), leaving at least middle section 218 in place, if another stair unit is to be located below this stair unit. Similarly, upper section 220 can be removed (along with upper termination elements 210*a* and 210*b*), leaving at least middle section 218 in place, if another stair unit is to be located above this stair unit. The sections of handrails 214*a* and 214*b* may be connected together using suitable internal couplings, such as those described below. Otherwise, the overall configuration and external appearance of handrails 214*a* and 214*b* is intended to resemble the handrails shown in the '016 publication.

Figure 5:
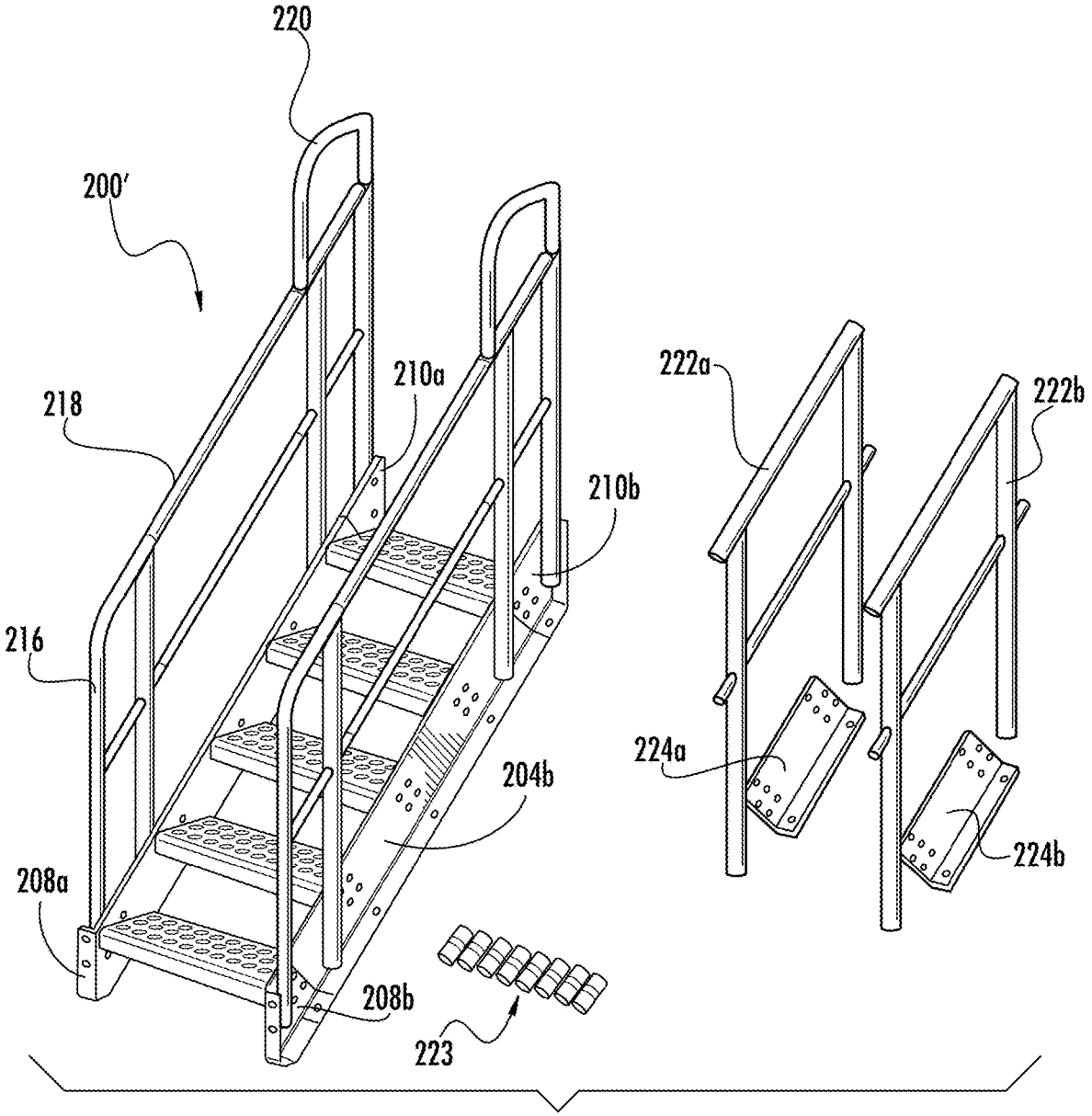
FIG. 5 illustrates a stair unit (in this case a 5-step unit), along with certain ancillary components.

FIG. 5 illustrates an exemplary stair unit 200' similar to the one shown in FIG. 5, but in this case having five steps. Ancillary components that may be provided with stair unit 200' to facilitate its use in a longer stair assembly are also shown. In this regard, a pair of transition handrail sections 222*a* and 222*b* can be used to span the gap otherwise left by the removal of handrail sections 216 or 220. A plurality of internal couplings, collectively indicated at 223, may also be provided to facilitate the interconnection of handrail sections. Web plates 224*a* and 224*b* are used instead of base elements 208*a-b* or upper termination elements 210*a-b* depending on whether the other stair unit is above or below this stair unit. In this regard, web plates 224*a* and 224*b* attach to a respective side plate 206 using the same holes as had been used for base elements 208*a-b* or upper termination elements 210*a-b*, but extend farther so as to also attach to the side plate of the next stair unit.

Figure 6:
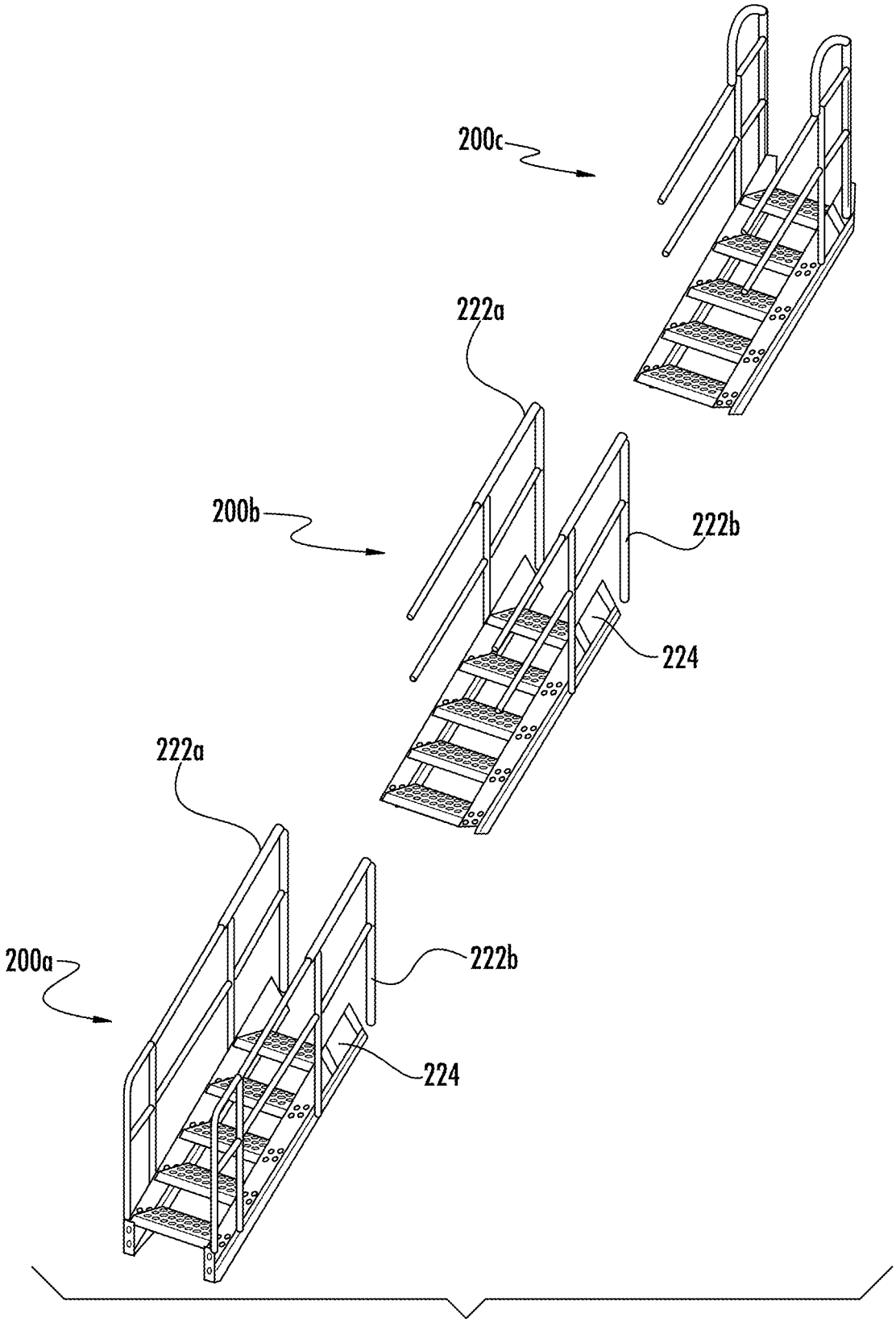
FIG. 6 is an exploded perspective view of multiple stair units that can be combined to create a longer stair assembly.

In this regard, FIG. 6 shows three stair units 200*a*, 200*b*, and 200*c*, each a 5-step stair unit in this example, about to be combined in order to produce a 15-step stair assembly. In stair unit 200*a*, upper termination elements 210*a-b* have been removed. Additionally, transition handrail sections 222*a-b* have replaced handrail upper sections 220. In stair unit 200*b*, base elements 208*a-b* and upper termination elements 210*a-b* have been removed. In addition, handrail lower sections 216 and handrail upper sections 220 have been removed. Transition handrail sections 222*a-b* are used in place of handrail upper sections 220. In stair unit 200*c*, base elements 208*a-b* and handrail lower sections 216 have been removed.

Figure 7:
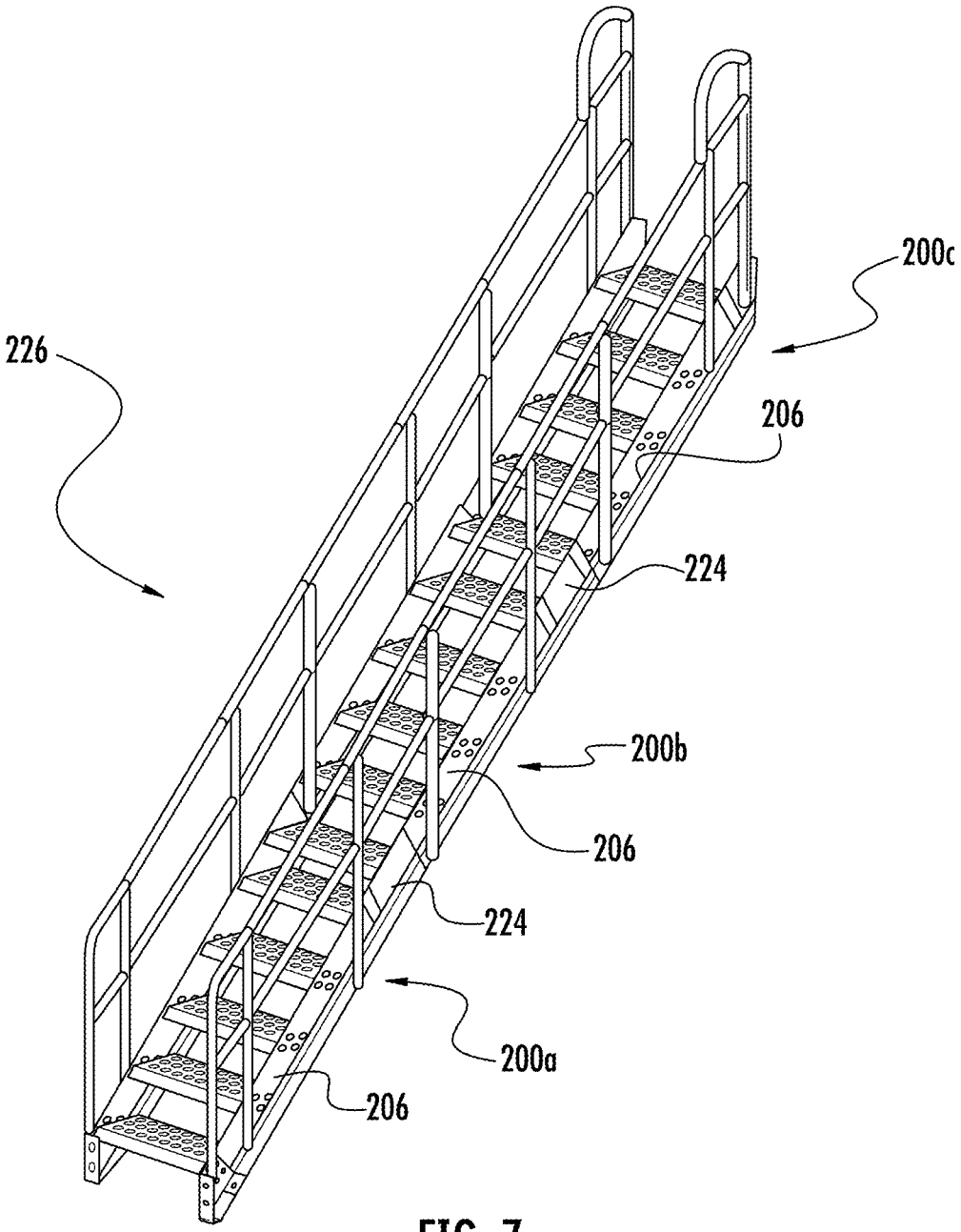
FIG. 7 is an assembled perspective view of the multiple stair units of FIG. 5.

Turning now to FIG. 7, the combined 15-step stair assembly 226 is illustrated. As can be seen, the stair units' side plates 206 have been interconnected on both sides using web plates 224. In other words, a pair of web plates 224 interconnects stair units 200*a* and 200*b* using the same attachment holes in side plates 206 that had been used by the upper termination elements 210 of stair unit 200*a* and the base elements 208 of stair unit 200*b*. Similarly, a pair of web plates 224 interconnects stair units 200*b* and 200*c* using the same attachment holes in side plates 206 that had been used by the upper termination elements 210 of stair unit 200*b* and the base elements 208 of stair unit 200*c*. The handrails of stair units 200*a*, 200*b*, and 200*c* are secured together using internal couplings to produce a continuous handrail structure on both sides of the steps. While three stair units of 5-steps each have been used in this example, one skilled in the art will appreciate the wide variety of different combinations that are allowed using embodiments of the present invention.

Figure 8A:
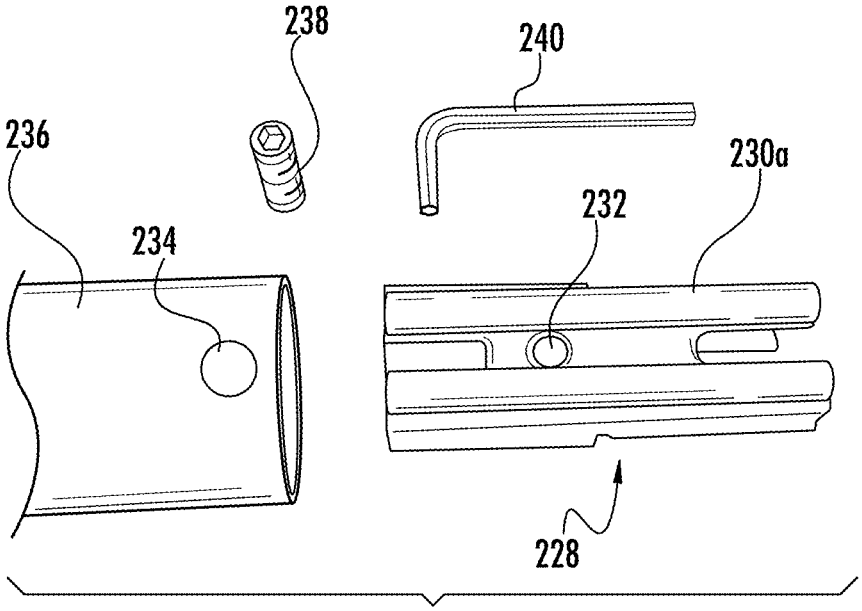
FIGS. 8A and 8B illustrate the manner in which handrail sections can be connected to each other in the stair assembly of FIG. 6.
Figure 8B:
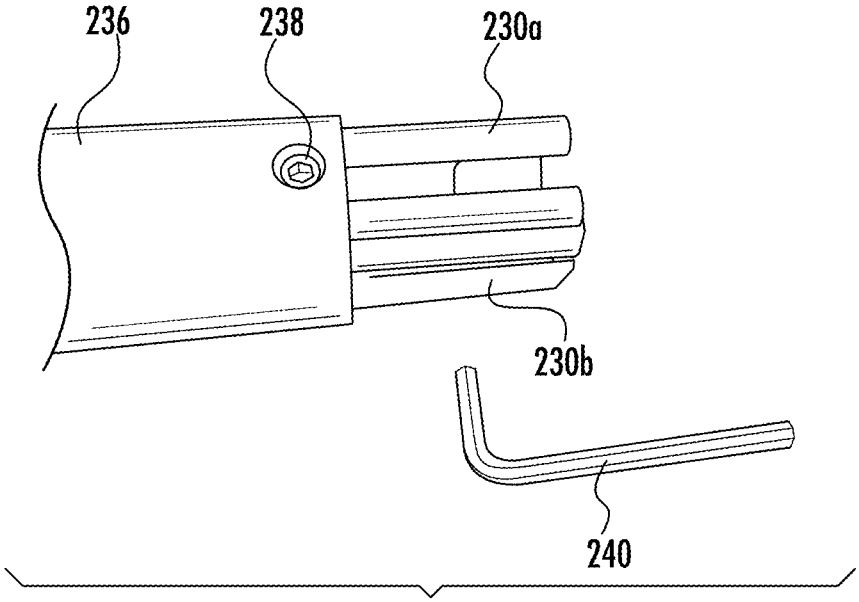

Referring now to FIGS. 8A and 8B, an exemplary internal coupling 228 is illustrated. Coupling 228 in this example has a pair of coupling elements 230*a-b* that are loosely connected together. At least one threaded hole 232 is defined in coupling 228. Hole 232 aligns with a set-screw hole 234 defined in an end of a tubular handrail 236. The set screw itself is indicated at 238, along with a typical hex wrench 240 used to tighten it in this case.

In order to connect handrails of different stair units together, internal coupling 228 is first positioned in the open end of one tubular handrail with set screw 238 in place. The tubular handrail of the other stair unit is abutted with the tubular handrail having coupling 228. Set screw 238 is then tightened so that coupling elements 230*a-b* expand into firm engagement with the inner surfaces of both tubular handrails. Preferably, hole 234 will be located on the underside of the tubular handrail so it will not normally be seen. One skilled in the art will appreciate that a similar coupling arrangement will preferably be used in every set of tubular handrails that will abut in the overall stair assembly.

Figure 9:
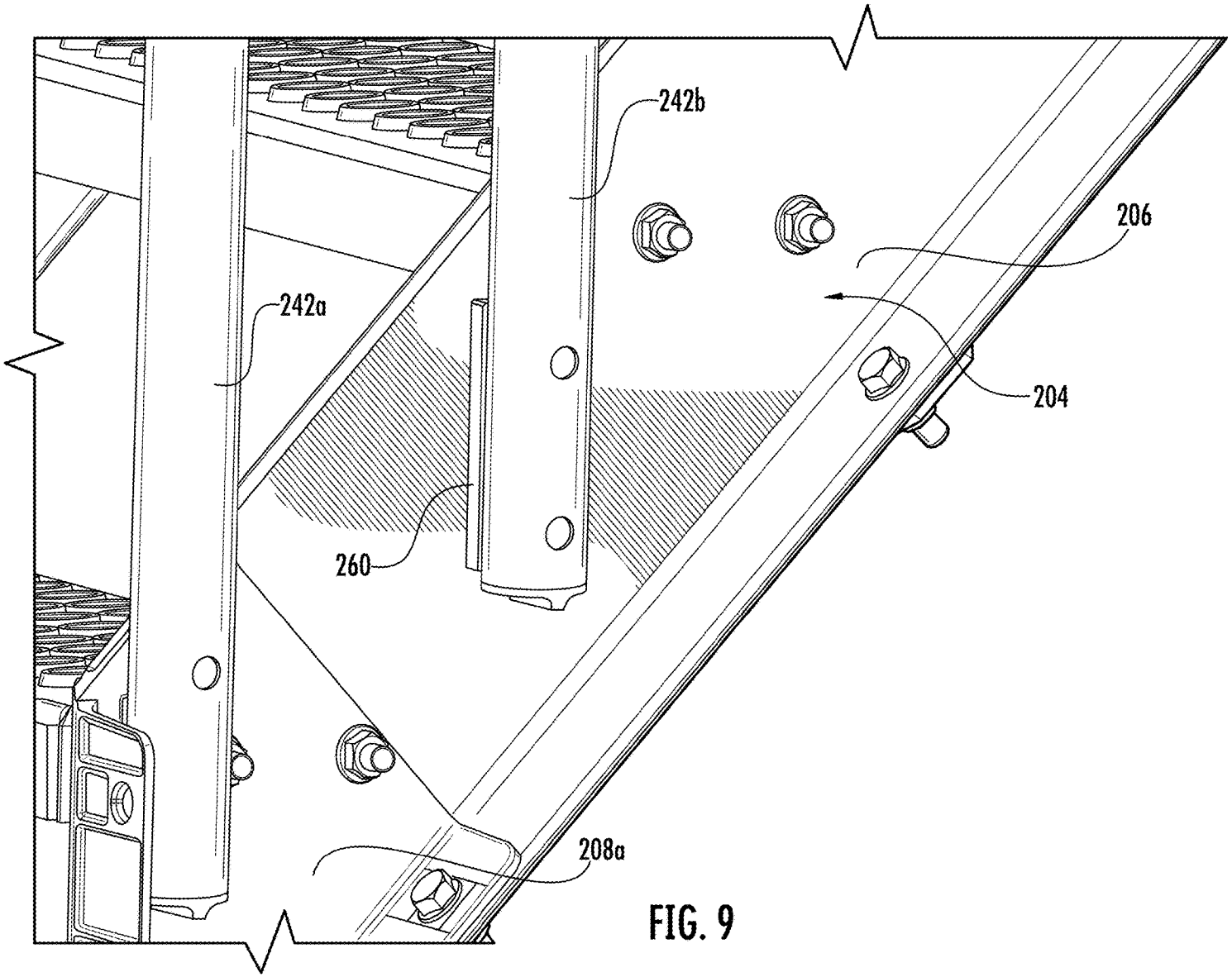
FIG. 9 is an enlarged perspective view of the manner in which handrails may be attached to a stair stringer (or "stair support") in accordance with an embodiment of the present invention.
Figure 11:
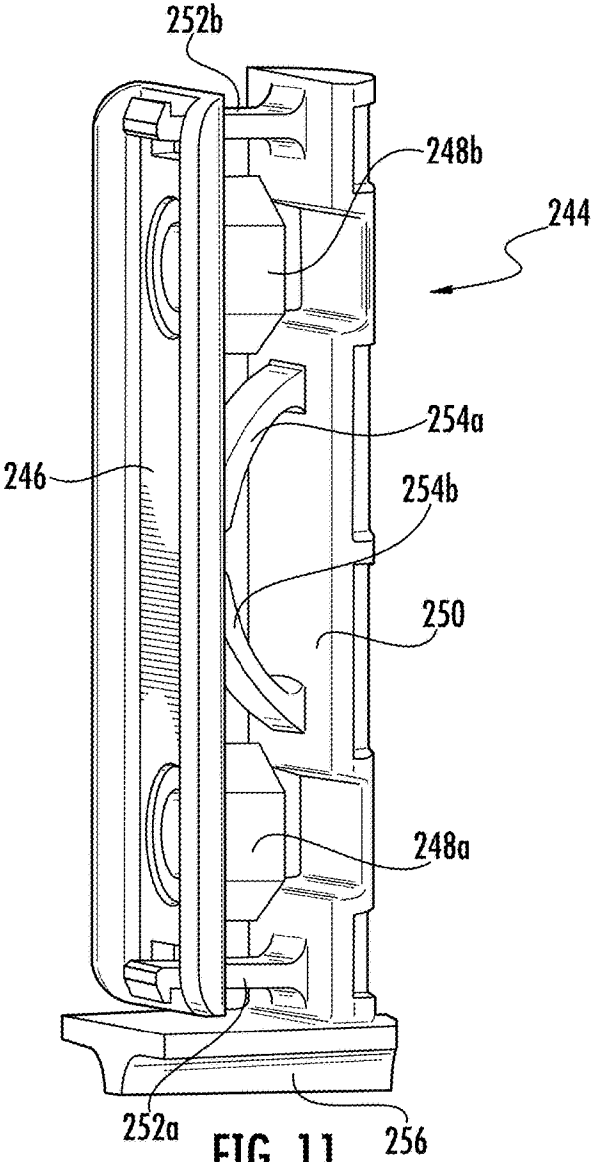
FIG. 11 is a perspective view of the nut plate locking device of FIG. 10.
Figure 10:
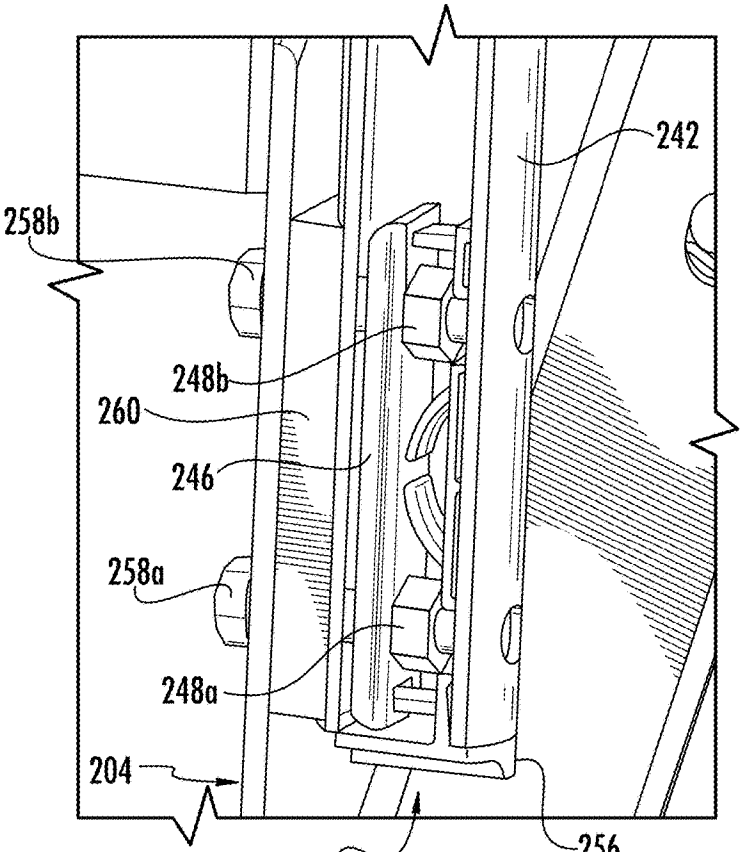
FIG. 10 is an enlarged view of the handrail attachment illustrated in FIG. 9, partially cut away to reveal a nut plate locking device in accordance with an embodiment of the present invention.

Referring now to FIGS. 9-11, a preferred manner for attaching the handrails to the stair stringers 204 will be described. In this regard, a pair of vertically-aligned holes are defined in stair stringer 204 at each location where a vertical support post for the handrail is to be attached. In FIG. 9, for example, support posts 242*a* and 242*b* are shown attached to stringer 204.

As can be seen most clearly in FIGS. 10 and 11, support post 242 is attached in this embodiment using a nut plate locking device (or "assembly") 244. Nut plate assembly 244 includes a rigid nut plate 246, typically formed of steel or other suitable metal, carrying a pair of threaded nuts 248*a-b*. Nuts 248*a-b* are in this case separate pieces that have been permanently and securely attached to nut plate 246, such as by welding. One skilled in art will appreciate that nut plate 246 and nuts 248*a-b* could alternatively be formed as a unitary part.

As shown, a spring plate 250, typically formed of a suitable polymeric material such as nylon, is loosely coupled to the back of nut plate 246. In this regard, spring plate 250 includes a pair of projections 252*a-b* removably received in corresponding upper and lower slots defined in nut plate 246. Flexible arms 254*a-b* slightly urge nut plate 246 away from spring plate 250. This allows relative movement between nut plate 246 and spring plate 250 to facilitate insertion of nut plate assembly 244. Also, the spring action of arms 254*a-b* tends to hold nut plate assembly 244 in the correct position until tightening can occur. Spring plate 250 preferably includes a flange 256 at its bottom end that limits insertion of nut plate assembly 244 such that the nuts 248*a-b* will aligned with corresponding holes in the support post.

Support post 242 is then attached to stringer 204 using bolts 258*a-b* that extend through holes in the stringer into threaded engagement with respective nuts 248*a-b*. As bolts 258*a-b* are tightened, nut plate 246 is drawn into secure engagement with the inner surface of post 242 to eliminate looseness in the handrail. In this embodiment, post 242 has a circular cross-section all the way to its bottom end. Thus, a handrail washer 260 with a flat side and a curved side is preferably positioned between stringer 204 and post 242, as shown. In other embodiments, the bottom of support post 242 can be formed into a "D" shape, thus eliminating the need for handrail washer 260. One skilled in the art will appreciate, however, that forming such a D-shaped portion of support post 242 involves additional processing steps that are avoided if washer 260 is used. Also, while nut plate assembly 244 has been described in relation to attachment of a support post of a stair handrail, one skilled in the art will appreciate that it can also be used to attach handrail units 400 to modular platform units 100.

Figure 13:
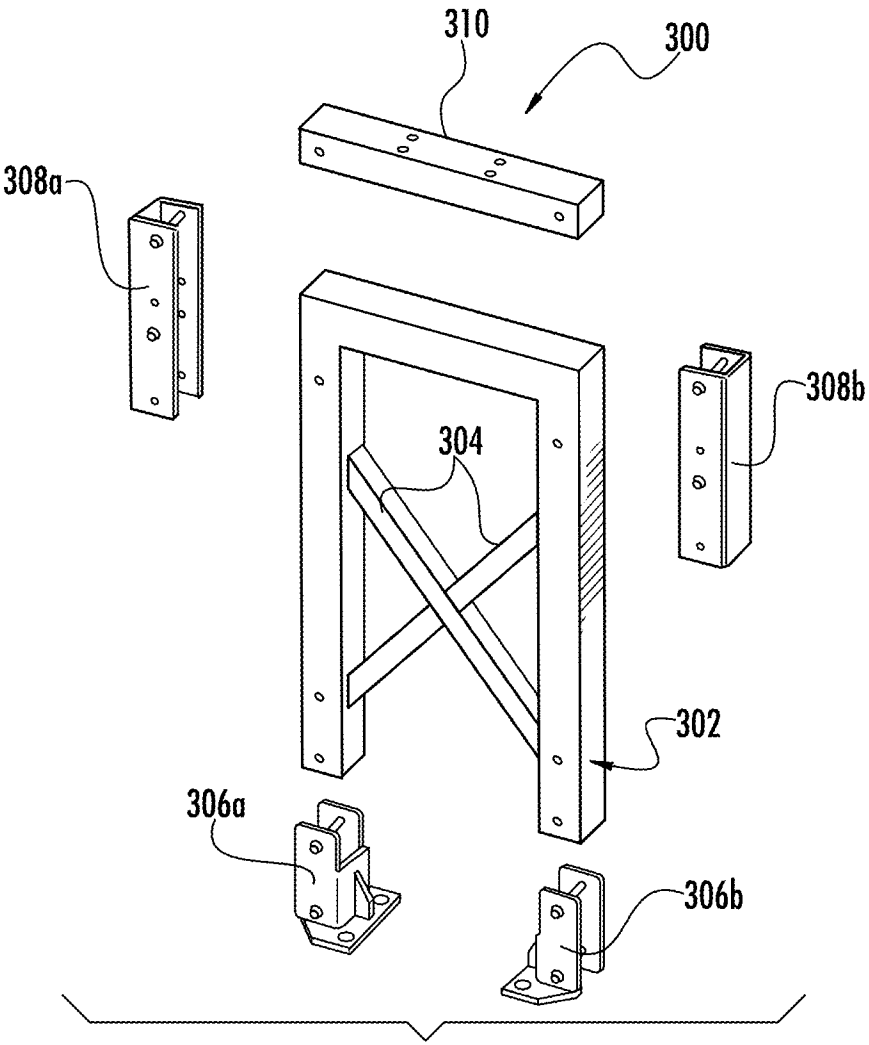
FIG. 13 is an exploded view of the tower unit of FIG. 12 to better show certain components thereof.
Figure 12:
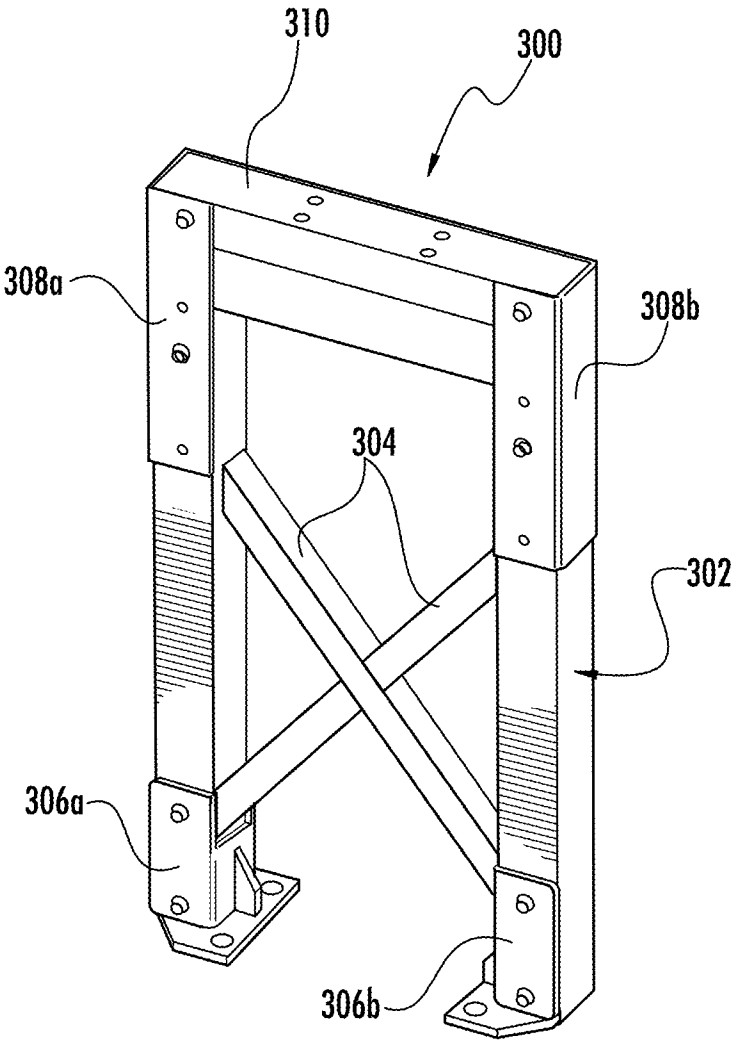
FIG. 12 illustrates an exemplary tower (or "stand") unit in accordance with an embodiment of the present invention.

Referring now to FIGS. 12 and 13, an exemplary tower unit 300 is illustrated. In this exemplary case, tower unit 300 corresponds to the rise of a 5-step stair unit, although a variety of tower units of different heights will typically be available corresponding to the different heights of available stair units. As shown, tower unit 300 has a main tower component 302 generally having the shape of an inverted "U" and formed of rectangular tubing in this example. Cross-supports 304 may extend between the legs of tower component 302 to facilitate structural integrity.

Similar to stair unit 200, tower unit 300 includes removable components that may or may not be used, or are used differently, depending on the situation. In this regard, a pair of removable base fittings 306*a-b* are provided at the bottom of the respective legs of tower component 302. For example, base fittings 306*a-b* may be attached using a pair of vertically aligned attachment holes extending through the legs of tower component 302. If this particular tower unit 300 is not the lowest tower unit in a taller tower assembly, these same holes are used to connect it to another tower unit below.

Removable side brackets 308*a-b* and top piece 310 are also provided. Side brackets 308*a-b*, which are generally U-shaped as shown, are shiftable to allow interconnection to another tower unit above. Top piece 310 is used at the top tower unit of the overall tower assembly (or at the top of tower unit 300 if it is used alone). In this example, top piece 310 is formed of rectangular tubing, and sits atop the upper beam of main tower component 302. Top piece 310 is held in place by fasteners (e.g., bolts) extending through aligned holes defined in it and brackets 308.

Figure 14:
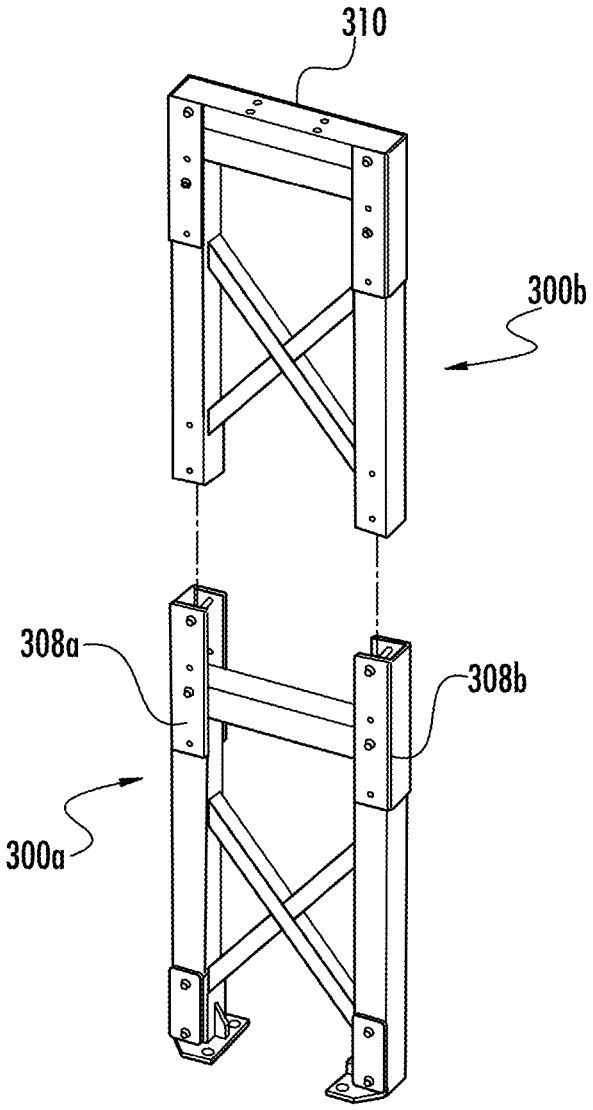
FIG. 14 is an exploded perspective view of multiple tower units that can be combined to create a taller tower assembly.

Referring now to FIG. 14, a pair of tower units 300*a* and 300*b* are being combined to form a taller tower assembly. As tower unit 300*b* will be the top unit in the tower assembly, it carries top piece 310. On tower unit 300*a*, brackets 308*a* and 308*b* are shifted up to accommodate the legs of tower unit 300*b*. After the legs of tower unit 300*b* are correctly positioned, fasteners (e.g., bolts) are inserted through aligned holes in the brackets and legs to secure everything together. (While a shiftable bracket is shown in this example, one skilled in the art will appreciate that different brackets could be used for attachment of top piece 310 and interconnection of tower units, if desired.) Advantageously, the tower assembly can be easily produced lying flat on the ground and then moved into an upright position.

Figure 15:
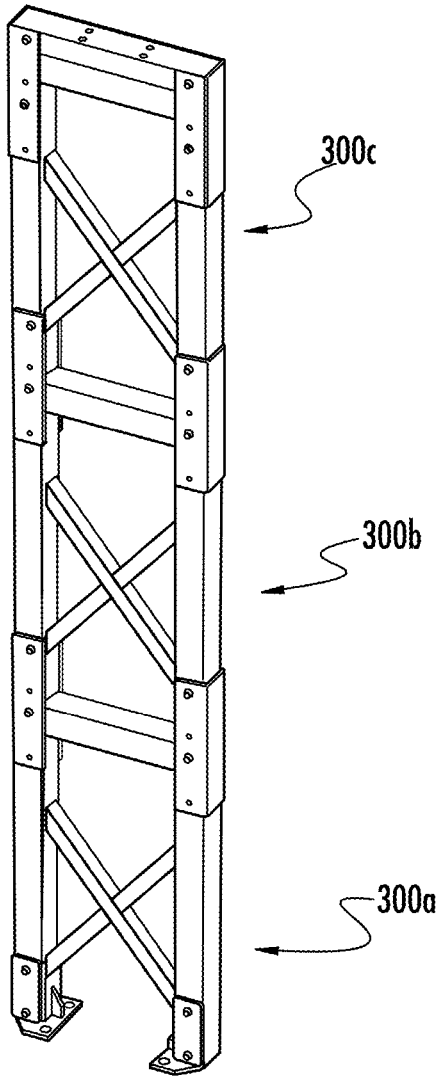
FIG. 15 is an assembled perspective view of multiple tower units.

In FIG. 15, a tower assembly is shown that was formed of three tower units 300*a*, 300*b*, and 300*c*. While the three tower units each have the same height in this example, tower units of different heights may be mixed and matched to achieve a desired overall height, as noted above.

Figure 16B:
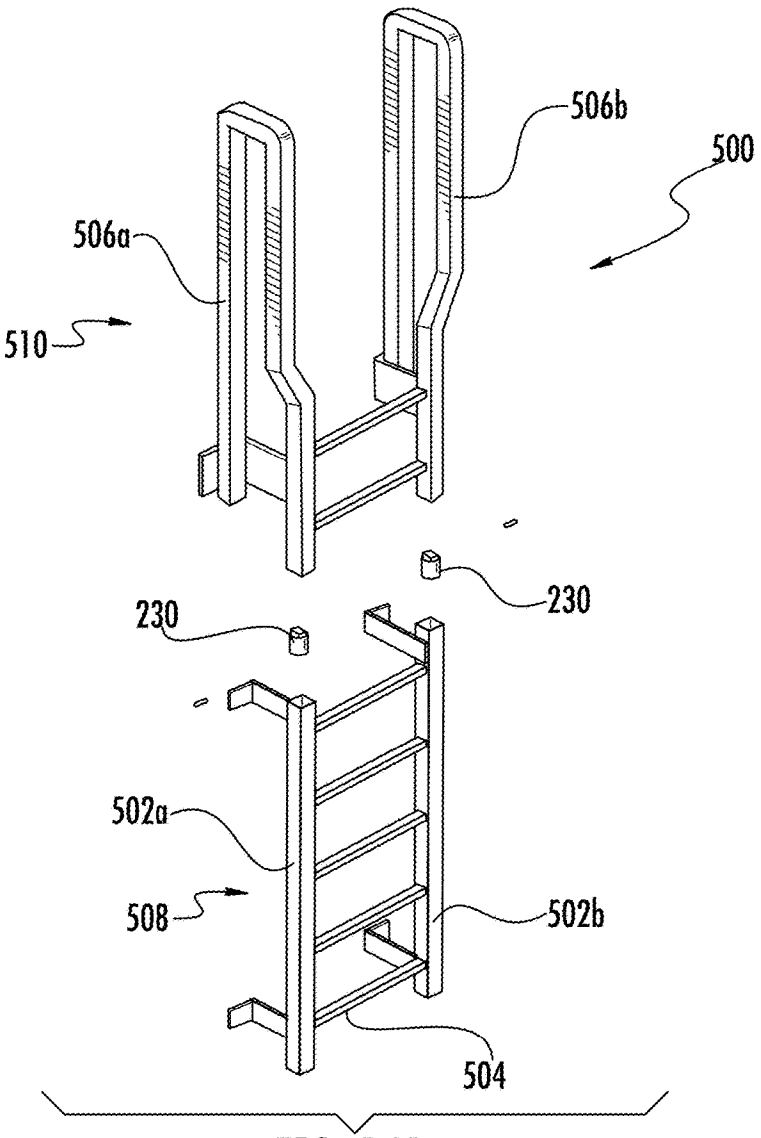
FIGS. 16A and 16B illustrate an exemplary ladder unit in assembled and disassembled states, respectively.
Figure 16A:
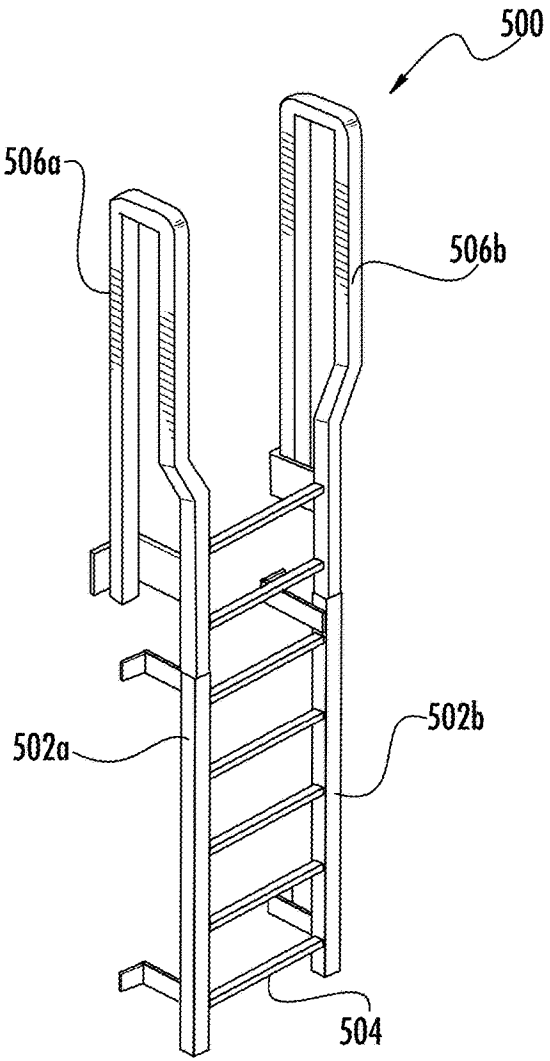
Figure 17C:
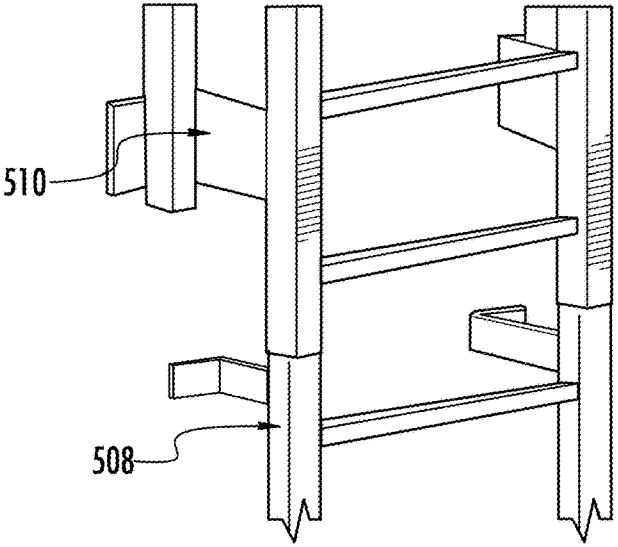
FIGS. 17A through 17C show different stages of connection between ladder assembly components in accordance with an aspect of the present invention.
Figure 17B:
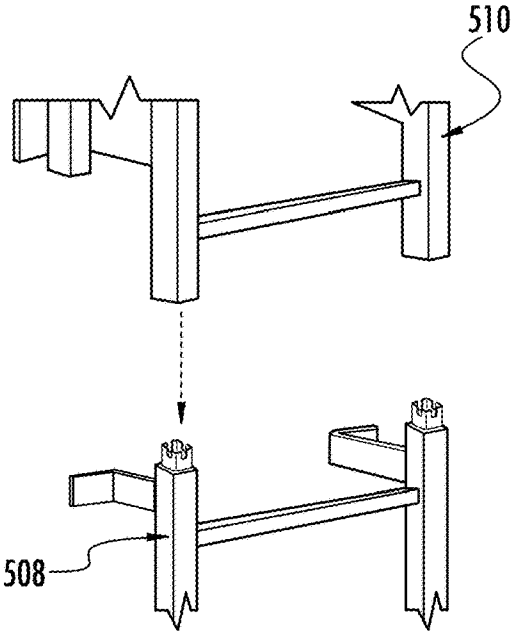
Figure 17A:
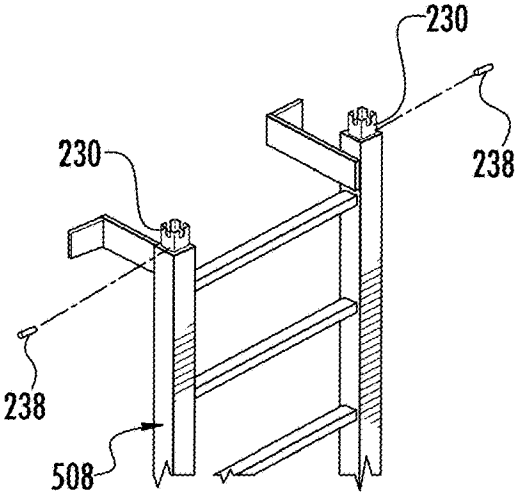

A ladder unit 500 is illustrated in FIGS. 16A and 16B. As shown, ladder unit 500 includes side rails 502*a-b* having rungs (such as rung 504) extending therebetween. In this embodiment, rails 502*a-b* extend into handrails 506*a-b* at their upper ends. Referring particularly to FIG. 16B, ladder unit 500 has a lower section 508 and an upper section 510 that can be separated to allow expansion of ladder height. As shown in FIGS. 17A through 17C, the interface between lower section 508 and upper section 510 may be connected together using coupling elements 230 as described above.

Figure 18:
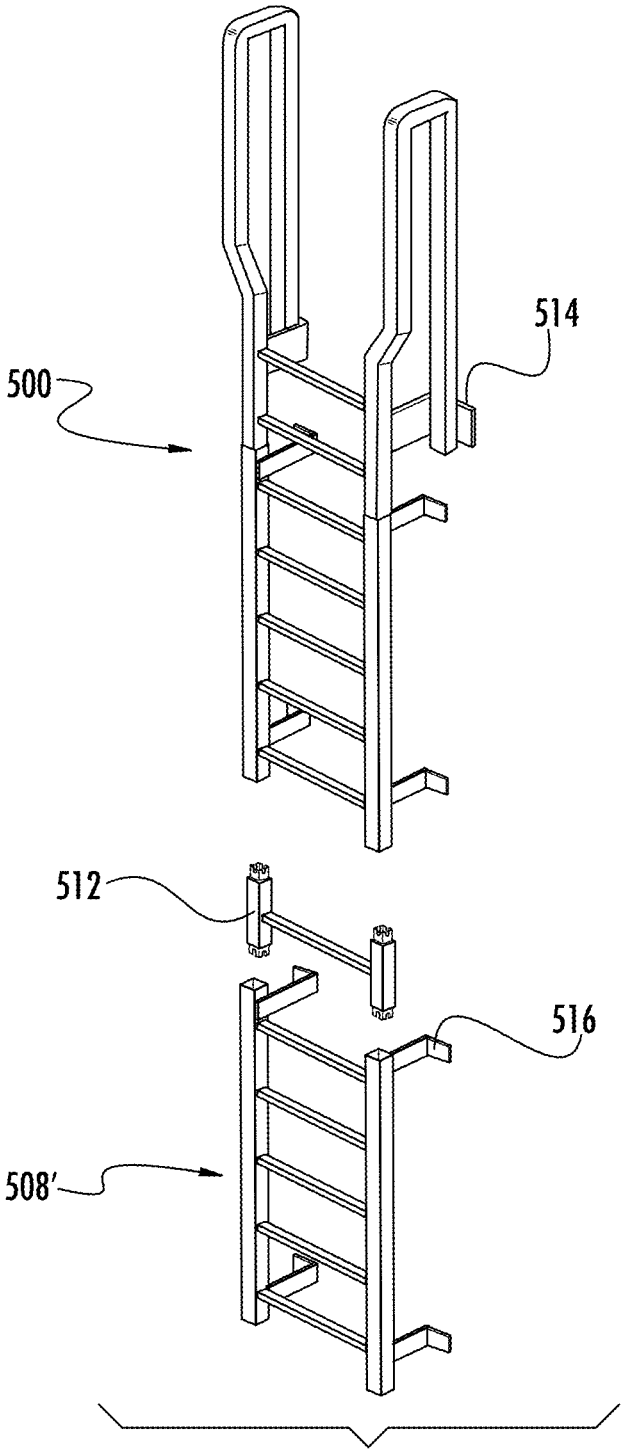
FIG. 18 shows the manner in which a longer ladder may be created according to an aspect of the present invention.

FIG. 18 illustrates how a taller ladder assembly may be formed from a plurality of ladder sections. In this case, an additional lower section 508' is added below an existing ladder unit 500. A spacer section 512 may be provided to ensure that attachment features for the overall ladder assembly are in the correct locations. In the illustrated embodiment, the ladder assembly is used in conjunction with a tower assembly of the type described above. Upper mounting brackets 514 attach to the side of a platform, whereas offset brackets 516 attach along legs of the tower assembly.

It can thus be seen that the present invention provides a modular platform system that is easily adaptable into a wide variety of configurations. One skilled in the art would be able to determine the most appropriate materials from which to form the various components described above in order to meet anticipated strength and rigidity requirements. In many cases, however, the various structural components may be formed of steel or another suitable metal.

While preferred embodiments of the invention have been shown and described, modifications and variations may be made thereto by those of ordinary skill in the art without departing from the spirit and scope of the present invention. In addition, it should be understood that aspects of the various embodiments may be interchanged both in whole or in part to yield still further embodiments. Furthermore, those of ordinary skill in the art will appreciate that the foregoing description is by way of example only, and is not intended to be limitative of the invention as further described in the appended claims.

What is claimed is:

1. A platform system comprising:

a platform structure having at least one modular platform unit with platform connection features on side surfaces thereof to which other components can be connected, said other components including at least two of another modular platform unit, a stair unit having a plurality of steps, a tower unit, a handrail unit, and a ladder unit;

said at least one modular platform unit having a square configuration with four sides of equivalent length, the four sides respectively forming the side surfaces on which the connection features are located so that the other components can be connected to any one of the side surfaces; and a stair assembly connected to said platform structure via said platform connection features, said stair assembly comprising a plurality of stair units, each having a plurality of steps, which are connected together to provide a number of steps equal to the sum of steps of said stair units, wherein handrail sections of said stair units are connected to form a continuous handrail along a length of said stair assembly.

2. A platform system as in claim 1, wherein said handrail sections of said stair units are connected together using transition handrail sections.

3. A platform system as in claim 2, comprising internal couplings for connecting handrails of said handrail sections and said transition handrail sections together.

4. A platform system as in claim 3, wherein said internal couplings comprise coupling elements that are tightened to engage an inner surface of said handrails.

5. A platform system as in claim 1, wherein said plurality of stair units comprises at least three of said stair units.

6. A platform system as in claim 5, wherein each of said plurality of stair units has no more than six steps.

7. A platform system as in claim 1, wherein handrail units and handrails of said stair assembly are attached to at least one of said platform structure and said stair assembly using a nut plate locking assembly inserted into a tubular end of a handrail support post.

8. A platform system comprising:

a platform structure having at least one modular platform unit with platform connection features on side surfaces thereof to which other components can be connected, said other components including at least two of another modular platform unit, a stair unit having a plurality of steps, a tower unit, a handrail unit, and a ladder unit;

said at least one modular platform unit having a square configuration with four sides of equivalent length, the four sides respectively forming the side surfaces on which the connection features are located so that the other components can be connected to any one of the side surfaces; and a stair assembly connected to said platform structure via said platform connection features, said stair assembly comprising a plurality of stair units, each having a plurality of steps, which are connected together to provide a number of steps equal to the sum of steps of said stair units, wherein left and right stringers of each said stair unit comprise a side plate having upper and lower stair connection features for attachment of upper termination elements and base elements, respectively, wherein said stair units of said stair assembly are interconnected together at an interconnection location via web plates that are attached to said side plates using said upper stair connection features in lieu of said upper termination elements of a first one of said stair units and said lower stair connection features in lieu of said base elements of a second one of said stair units at the interconnection location.

9. A platform system comprising:

a platform structure having at least one modular platform unit with platform connection features on side surfaces thereof to which other components can be connected, said other components including at least two of another modular platform unit, a stair unit having a plurality of steps, a tower unit, a handrail unit, and a ladder unit;

said at least one modular platform unit having a square configuration with four sides of equivalent length, the four sides respectively forming the side surfaces on which the connection features are located so that the other components can be connected to any one of the side surfaces;

a stair assembly connected to said platform structure via said platform connection features, said stair assembly comprising a plurality of stair units, each having a plurality of steps, which are connected together to provide a number of steps equal to the sum of steps of said stair units; and a tower assembly connected to said platform structure via said platform connection features, said tower assembly comprising a plurality of tower units connected together to provide a total height corresponding to a height of said stair assembly, wherein said tower units are interconnected using generally U-shaped brackets.

* * * * *